US005213050A

United States Patent [19]

Juvik-Woods

[11] Patent Number: 5,213,050

[45] Date of Patent: May 25, 1993

[54] INTEGRATED PAPER CARGO PALLET

[75] Inventor: Harry C. Juvik-Woods, San Rafael, Calif.

[73] Assignee: Damage Prevention Products, Inc., Benicia, Calif.

[21] Appl. No.: 906,221

[22] Filed: Jun. 26, 1992

[51] Int. Cl.[5] ..... B65D 19/00

[52] U.S. Cl. ..... 108/51.3; 108/56.1

[58] Field of Search ..... 108/51.3, 56.1, 56.3, 108/51.1

[56] References Cited

U.S. PATENT DOCUMENTS

| | | | |
|---|---|---|---|
| 3,407,758 | 10/1968 | Simkins | 108/56.3 X |
| 3,661,099 | 5/1972 | Shelor | 108/56.3 X |
| 3,685,463 | 8/1972 | Francis | 108/56.3 |
| 3,982,057 | 9/1976 | Briggs et al. | 108/51.3 X |
| 4,378,743 | 4/1983 | McFarland | 108/56.3 X |
| 4,685,401 | 8/1987 | Sheffer | 108/56.3 X |
| 4,735,154 | 4/1988 | Hemery | 108/56.1 |
| 4,765,252 | 8/1988 | Shuert | 108/56.1 X |
| 4,790,249 | 12/1988 | Webb | 108/56.1 X |
| 5,129,329 | 7/1992 | Clasen | 108/51.3 |

*Primary Examiner*—Jose V. Chen
*Attorney, Agent, or Firm*—E. Thomas Wheelock

[57] ABSTRACT

This is a pallet as might be used to support cargo during that cargo's transportation or storage. The pallet is constructed of paper or functionally equivalent sheet-stock. The pallet design involves a central platform or deck constructed of a honeycomb filler supported by a number of footblocks holding the central platform off the floor. The bottom of the pallet is covered by a combination of sheets patterned in such a way that the legs supporting the central platform are integral with that central platform; that is, the footblocks (or legs) do not have a seam at their juncture to the central platform. Desirably the lower portion is formed of two sheets; one sheet ("the bottom cover") is cut and folded in such a way that the legs and the surface adjacent the bottom of the central portion are of the shape in which the pallet is finally used. The other sheet ("lower facing sheet") is of the general size and shape of the bottom with cutouts allowing the footblocks (covered by the bottom cover sheet) to protrude through that lower facing sheet. It is positioned adjacent the bottom surface of the central platform. The upper surface of the central platform is covered with a generally continuous sheet ("the upper facing sheet"). The upper facing sheet may be a corrugate or heavy stock paper depending upon its ultimate usage. To enhance the torsional and deflective strength of the central platform and thence that of the pallet, a corrugated sheet may be used as the upper facing sheet and positioned so that the corrugations of the upper facing sheet and those of the lower facing sheet are not parallel. Additionally, the various corrugated sheets may be folded over the edges of the honeycomb core and fastened to another other surface.

15 Claims, 4 Drawing Sheets

INTEGRATED PAPER CARGO PALLET

FIELD OF THE INVENTION

This invention is a pallet as might be used to support cargo during that cargo's transportation or storage. The pallet is constructed of paper or functionally equivalent sheetstock. The pallet design involves a central platform or deck constructed of a honeycomb filler supported by a number of footblocks holding the central platform off the floor. The bottom of the pallet is covered by a combination of sheets patterned in such a way that the legs supporting the central platform are integral with that central platform; that is, the footblocks (or legs) do not have a seam at their juncture to the central platform. Desirably the lower portion is formed of two sheets; one sheet ("the bottom cover") is cut and folded in such a way that the legs and the surface adjacent the bottom of the central portion are of the shape in which the pallet is finally used. The other sheet ("lower facing sheet") is of the general size and shape of the bottom with cutouts allowing the footblocks (covered by the bottom cover sheet) to protrude through that lower facing sheet. It is positioned adjacent the bottom surface of the central platform. The upper surface of the central platform is covered with a generally continuous sheet ("the upper facing sheet"). The upper facing sheet may be a corrugate or heavy stock paper depending upon its ultimate usage. To enhance the torsional and deflective strength of the central platform and thence that of the pallet, a corrugated sheet may be used as the upper facing sheet and positioned so that the corrugations of the upper facing sheet and those of the lower facing sheet are not parallel. Additionally, the various corrugated sheets may be folded over the edges of the honeycomb core and fastened to another other surface.

BACKGROUND OF THE INVENTION

A pallet is a portable, horizontal, rigid, platform used as a base for assembling, storing, stacking, handling goods as a unit load. Conventional pallets are typically constructed of wood and are made by stapling or nailing a number of boards (known as "deckboards") at their ends to a number of continuous solid boards (known as "stringers"). The upper set and lower set (where used) of deckboards thereby form an open area defined by the thickness of the stringers. This opening is used to accommodate a fork lift or hand truck. In this way the pallet may be moved from place to place by lifting the pallet and its load off the floor.

The vast majority of all pallets used in the U.S. are constructed of wood, but wood pallets have many disadvantages. Labor and material costs for wooden pallets have increased faster than inflation. Because of their expense, the pallets are often reused or returned to their place of origin. The cost of returning empty pallets to their owners is obviously high. Additionally, the average weight of a wooden pallet is about forty pounds. Since shipping costs are usually tied to the weight of the goods shipped, the cost of shipping is increased by the weight of the pallet. Indeed, pallets are sufficiently heavy that smaller warehouse workers are able manually to move the pallets only with some difficulty. Wooden pallets are often damaged during use and, because of the pallet cost, must be repaired if possible or disposed of. Depending upon the industry involved, pallets may be used between two and four times before they are disposed of. Disposal of any solid materials including broken pallets is an increasingly difficult and costly problem.

My invention is a pallet constructed of paper involving a central platform or deck constructed of a honeycomb filler. The bottom of the pallet is covered by a combination of sheets (which may be corrugate) which are patterned in such a way that the footblocks supporting the central platform are integral with that central platform; that is, the footblocks (or legs) do not have a seam at their juncture to the central platform. Desirably the lower portion is formed of two sheets; one sheet ("the bottom or lower cover") is cut and folded in such a way that the legs and the surface adjacent the bottom of the central portion are of the shape in which the pallet is finally used. The other sheet ("lower or bottom facing sheet") is of the general size and shape of the bottom of the central platform with cutouts allowing the footblocks (covered by the bottom cover sheet) to protrude through that lower facing sheet. It is positioned adjacent the bottom surface of the central platform. The upper surface of the central platform is covered with a generally continuous sheet ("the upper facing sheet"). The upper facing sheet may be a corrugate or heavy stock paper depending upon its ultimate usage. To enhance the torsional and deflective strength of the central platform and thence that of the pallet, a corrugated sheet may be used as the upper facing sheet and positioned so that the corrugations of the upper facing sheet and those of the lower facing sheet are not parallel. Additionally, the various corrugated sheets may be folded over the edges of the honeycomb core and fastened to another other surface. In addition to the inherent strength and low cost of my pallet, by careful selection of construction materials, my design may be completely recycled as paper without separation into constituent parts.

There are a number of pallet designs which are made mostly of paper.

For instance, U.S. Pat. No. 3,661,099, to Shelor, shows a paper shipping pallet having a deck having a core section made of small strips cut from single, double, or triple wall corrugated paper board sheet stock glued face to face. Sheets of corrugated are glued to the longitudinal edges of the composite core. The core and facing sheets are desirably of a specific size of corrugated sheets, i.e., having a size "A" flute or better. The legs of the pallet appear to be wooden blocks.

U.S. Pat. No. 3,650,459, to Tucker, shows a paper pallet design involving a folded corrugate sheet as the cargo support area. That cargo deck is provided with a number of pallet feet (which operate as spacer blocks within the cargo deck) made of molded plastic material such as polystyrene. The use of a honeycomb core within the cargo support area is not disclosed.

U.S. Pat. No. 3,952,672, to Gordon et al, shows a disposable pallet made of a single folded corrugated sheet. The use of a honeycomb core on the cargo support area is not disclosed.

U.S. Pat. Nos. 4,867,074 and 5,001,991, to Smith, each show a pallet design in which the cargo deck is made up of a large number of girders folded from corrugated sheet and assembled with a series of cross girders. The use of a honeycomb core in the cargo support area is not disclosed.

U.S. Pat. No. 4,790,249, to Webb, shows a pallet design in which the cargo deck is made up of facing sheets separated by a number of blocks having a specific design. The block design involves a cellulosic material glued together by a bonding material (such as ureaformaldehyde) all extruded into the shape of a box beam. The boxes are positioned so to protect the deck from the tines on a fork lift.

Netherlands Patent Application 83-00024 shows an interesting design for a paper pallet. The cargo support deck appears to be constructed of a number of loops of paper glued together at a number of sites within the deck and also glued to a periphery forming the edge of the deck. Neither the use of a honeycomb core nor the use of corrugated sheet in the cargo deck support area is disclosed.

There are few disclosures showing the use of honeycomb materials in the core of the cargo support deck.

One such disclosure is Published U.K. Patent Application 2,213,462-A to Green et al. This published application shows a paper pallet design in which the cargo deck is made up of two face sheets of, e.g., corrugated cardboard and having an open structure such as a paper or card honeycomb between them. It is said that the deck may be raised from the floor using feet of similar construction. The deck core is made to be penetrable by the tines of a fork lift. There is no suggestion that the corrugated sheets on alternate sides of the core should be positioned so that the flutes are not parallel. Furthermore, the disclosure is silent on the use of a corrugated sheet folded over the edge of the central core and fastened to the opposite side, and the disclosure does not suggest legs which are integral with the skin on the central core.

U.S. Pat. No. 4,319,530, to Moog, discloses a pallet, said to be disposable, having a cargo supporting deck area made up of a central core of a honeycomb made of laminated corrugate. The core is faced with one or more corrugated sheets glued to the core. The facing on the cargo support surface of the central core may be made up of multiple layers of corrugated sheets. Although these multiple facing layers are said to be positionable so to permit "cross laminating where the flutes of the different sheets are oriented at right angles", there is no suggestion that use of corrugated sheets on alternate sides of the core positioned so that the flutes are not parallel is useful. Further, the disclosure is silent on the use of a corrugated sheet folded over the edge of the central core and fastened to the opposite side nor, obviously, is any benefit accorded such a folded sheet.

None of these disclosures show a pallet constructed of paper involving a central platform or deck constructed of a honeycomb filler bounded on the top and bottom surfaces by corrugated sheets nor do these disclosures show the concept of using a folded corrugated sheet as both the skins on the individual legs supporting the central core and on the bottom of the central core itself. These disclosures do not show the benefit of increased torsional and deflective strength of the central platform via the use of carefully positioned corrugated sheets such that the corrugations or flutings in those face sheets are not parallel.

SUMMARY OF THE INVENTION

Figure 1A:
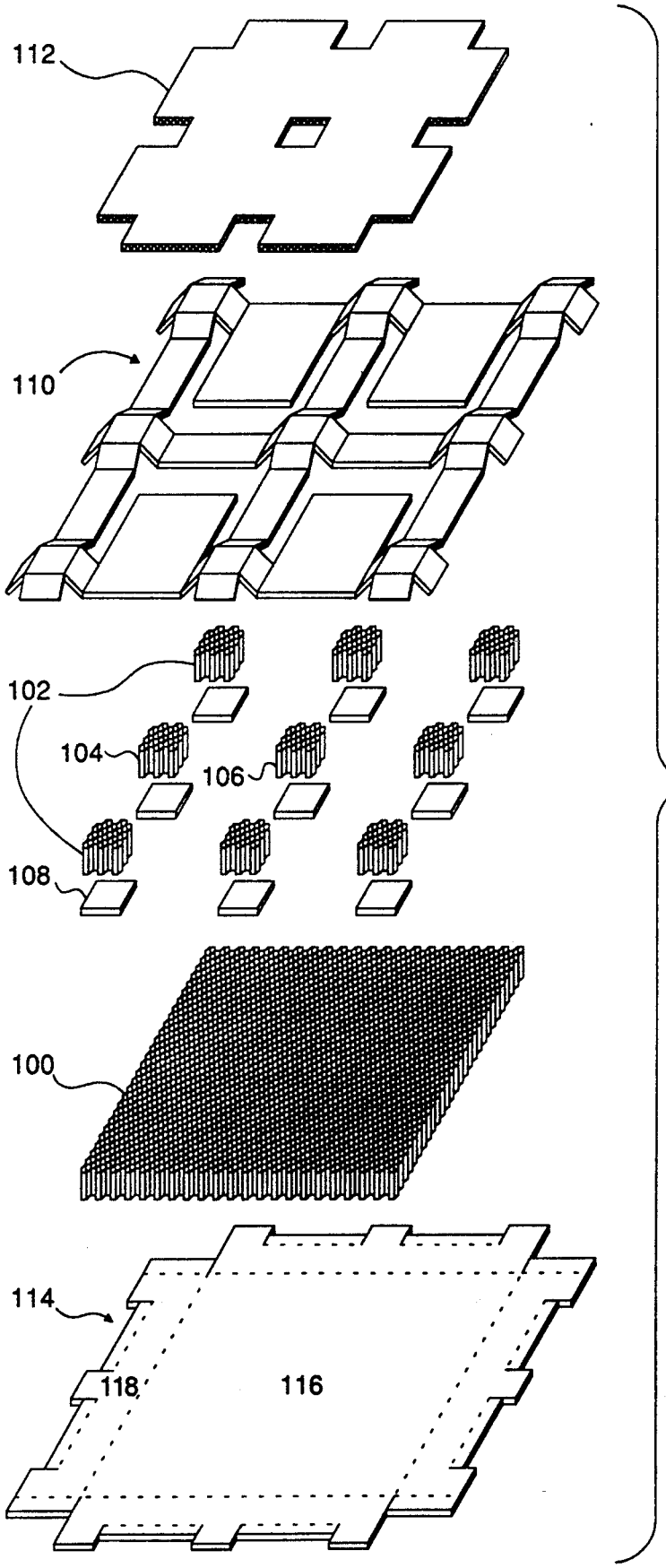
FIG. 1A is an exploded drawing of the components of the basic configuration of the invention.

In general, this invention is a pallet as might be used to support cargo during that cargo's transportation or storage. The pallet is constructed of paper. The pallet design involves a central platform constructed of a honeycomb filler. The bottom of the pallet is covered by a combination of sheets (which may be corrugate) which are patterned in such a way that the footblocks supporting the central platform are integral with that central platform; that is, the footblocks (or legs) do not have a seam at their juncture to the central platform. Desirably the lower portion is formed of two sheets; the bottom or lower cover sheet is cut and folded in such a way that it covers at least the footblocks and the surface adjacent the bottom of the central portion. It is of the shape of lower view of the pallet as the pallet is finally used. The other sheet is a lower or bottom facing sheet and is of the general size and shape of the bottom of the central platform with cutouts allowing the footblocks covered by the bottom cover sheet to protrude through that lower facing sheet. It resides adjacent the bottom surface of the central platform. The upper surface of the central platform is covered with a generally continuous sheet called the upper facing sheet. The upper facing sheet may be a corrugate or heavy stock paper depending upon its ultimate usage. To enhance the torsional and deflective strength of the central platform and thence that of the pallet, a corrugated sheet may be used as the upper facing sheet and positioned so that the corrugations of the upper facing sheet and those of the lower facing sheet are not parallel. Additionally, the various corrugated sheets may be folded over the edges of the honeycomb core and fastened to another other surface. In addition to the inherent strength and low cost of my pallet, by careful selection of construction materials, my design may be completely recycled as paper without separation into constituent parts.

Although the invention may be made of a variety of materials, I prefer to construct the pallet from materials which may be readily recycled using commercially available technology. For instance, the various sheet material is desirably from kraft paper or other similar paper stock. Of course, depending upon the service into which the pallet is placed, other materials may be selected, e.g., MYLAR, polyethylene, polypropylene (clear or fibrous paper product), or the like is acceptable. Some thermosetting polymeric materials are not currently widely recyclable and may not be the best of choices for the pallet from that viewpoint. However even with nonrecyclable materials the improvements of the pallet design will be apparent. Choice of materials and methods to join together the various components of the pallet may also be made on the basis of recyclability. For instance, most water-based glues, e.g., hide glue, mucilage, etc. are glues compatible with the kraft paper recycling processes. Heat sealing thermoplastic materials such as polypropylene is an expedient using no adhesive.

FIG. 1A is an exploded diagram showing the components of the basic configuration of the invention. The pallet in FIG. 1A has been turned upside down to better show the components of the pallet and their relationship. In this configuration, the central core (100) comprises an expanded honeycomb material having an upper surface, lower surface, and edges. The honeycomb's density and the thickness of the paper used are two engineering parameters which largely determine the strength of the central core and permit it to be used in this invention. If the method for joining the two facing sheets to the core is properly carried out, the cells within the core are isolated from each other. The core strength is enhanced by the formation of these closed cells and imparts an amount of springiness and shock absorbing capabilities to the core.

Attached to the central core (100) are several footblocks (102, 104, 106) which may also be an expanded honeycomb material. As an alternative, these blocks may also be constructed from laminated corrugate if so desired. The configuration shown in FIG. 1A is a "four-way" pallet in that the vehicle used to move the pallet and its load may enter the space beneath the central core from any of four different directions. The variation shown in FIG. 1A includes nine cornerblocks; corner footblocks (102) located at each corner of the central core (100), side footblocks (104) located at the approximate center of each side of the central core (100), a central footblock (106) located in the approximate center of the central core (100). Although this configuration is without question one of the most likely to be used commercially, this invention also includes specialty pallets in which only the corner footblocks (102) are used. It is occasionally desirable to include sheets of paper (108) or other material between the footblocks and the central core to serve as glue surfaces at the end of the passageways in the honeycombs in the footblocks and the central core.

The assembly comprising the central core (100) and the various footblocks (102, 104, 106) with the optional glue surfaces papers (108) is then covered with a carefully patterned lower cover (110). This lower cover is shown partially folded in FIG. 1A and is also shown in plan view in FIG. 1C. The concept behind the shape of this lower cover is that it forms a reasonably integrates lower view which does not present a weak or seam at the junction of the footblocks to the central core and provides a significant glue surface area between the cover and the central core. The absence of seams between the footblocks and the central core in addition to the fact that the skin on each of the footblocks is also glued to the central core prevent s the feet form being easily severed from the central core by a misplaced forklift tine or the like. Said another way, because the lower cover (110) is functionally unitary as the skin of the footblocks and the lower skin on the central core, the footblocks are very sturdy and likely will stand more abuse than any others in the paper pallet art. Because the lower cover (110) is most desirably a single piece, it may be placed in or folded into an assembly form or jig, glue applied, footblocks inserted into the relevant receiving areas in the lower cover, the central core applied, and the upper facing applied.888888

Figure 1B:
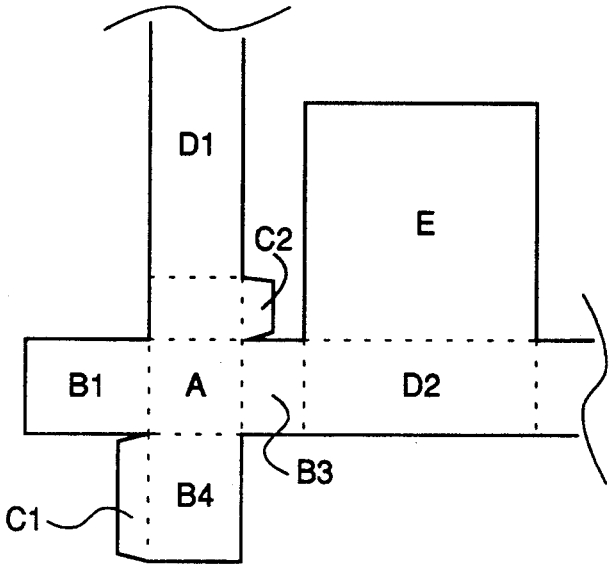
FIG. 1B shows an expanded partial plan of a corner of the FIG. 1A lower cover.
Figure 1C:
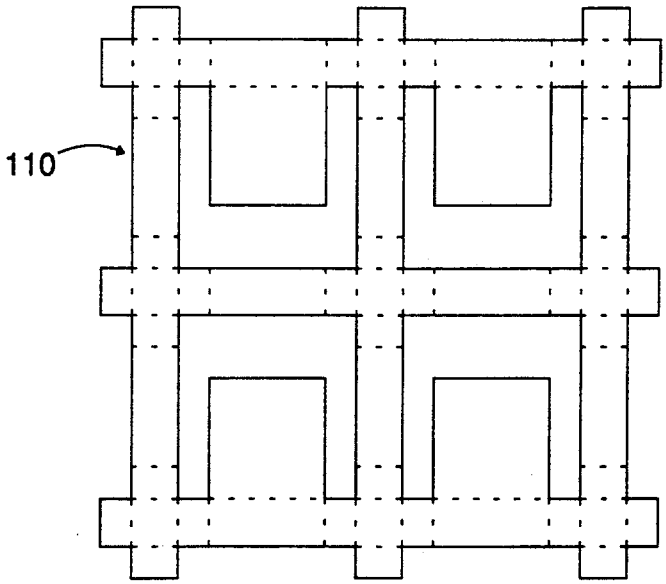
FIG. 1C shows a plan view of the lower cover of the pallet shown in FIG. 1A.

The sections of the lower cover and their functions are explained in conjunction with the blow-up in FIG. 1B. The portion marked "A" fits the bottom of the corner footblocks (102). The portions marked "B3" and "B4" are folded onto the cornerblock interior walls which reside between the bottom of the footblock and here the footblock meets the bottomside of the central core. Portion "B1" fits against the outside of the footblock and the outside edge of the central core. Portion "B4" is the same size and shape as is "B1" but also has glue tab "C1" attached in such a way that it may be folded over and glued onto "B1". Similarly, tab "C2" may be folded over portion "B3". Therefore, for each corner footblock, "A" forms the bottom and "B1", "B2", "B3", and "B4" form the sides of the footblock. Portions "D1" (attached to "B2") and (attached to "B3") adhere to the underside of the central core (100) and are, in turn, attached to the underside of the central core (100) and are, in turn, attached to the other portions of the lower cover (100) which form the sides of the adjacent side footblocks (104). Portion "E" is a flap which is glued directly to the underside of the central core (100).

A variation of the design of the lower cover (110) entails the concept of assembling the cover from several pieces. For instance, two "mirror image" portions such as are to the right and left of lines of lines "x" and "y" imposed on the lower cover (110) in FIG. 1C. A central portion would, as found between the two lines "x" and "y", also be necessary to complete the lower cover.

Completing the required portions of the lower end of the pallet is the lower facing (112). The lower facing (112) is cut in such a way that it fits over the assemblage of the various footblocks (102, 014, 106) after they have been concealed by the skin formed from the lower cover (110). Its edges fit up to the edge of the central core (100). It is glued to the lower cover (110) and serves to further stabilize the footblocks from movement upon abuse and to impart excellent strength to the central platform and to the overall pallet.

The final portion of this variation of the inventive pallet is the upper facing sheet (114). As is shown in FIG. 1A, upper facing sheet (114) has a central area (116) which approximately corresponds in size and shape to the upper surface of the central core (100). On each side of the upper facing sheet (114) are side portions (118) which fold down over the sides of the central core (100) and the various footblocks (102, 104, 106) which, of course, have been previously covered with lower cover (110). Various tabs are also provided to fold over the bottom side of the lower facing sheet (120) and to fold around the outside corners of the central core (100) and the corner footblocks (102) after they have been covered with the lower cover (110). The surfaces of the upper facing sheet which are adjacent another piece of cardboard are glued to those adjacent sheets. As was noted above, if the method for joining the upper facing sheet (114) is properly to the central core (100) is properly carried out, the cells within the core honeycomb are sealed and are isolated from each other. The core strength is enhanced by the formation of these closed cells and imparts an amount of springiness and shock absorbing capabilities to the central core (100).

It is desirable, when both the lower facing sheet (112) and the upper facing sheet (114) are corrugates, to position the respective sheets such that the flute s in the corrugate of lower facing sheet (112) are not parallel to the flutes in upper facing sheet (114). The angle between the respective flutes may vary between about 30° and 90° although for a very practical pallet from the vantage of strength, versatility, and ease of construction, an included angle between the flutes of about 90° is desirable.

Central to this invention are the following:

a.) the lower cover (110) covers the majority of the underside of the central platform (100), covers the exterior of the footblocks attached to the central platform, has no edges adjacent the juncture the of the footblocks and the central platform, is functionally continuous between adjacent footblocks, and adheres to the bottom of the central deck between the footblocks, and b.) the lower facing sheet (112) is cut in such a way that it fits over the assemblage of the various footblocks (102, 104, 106) after they have been concealed by the lower cover (110). It is glued to the lower cover (110).

Figure 2A:
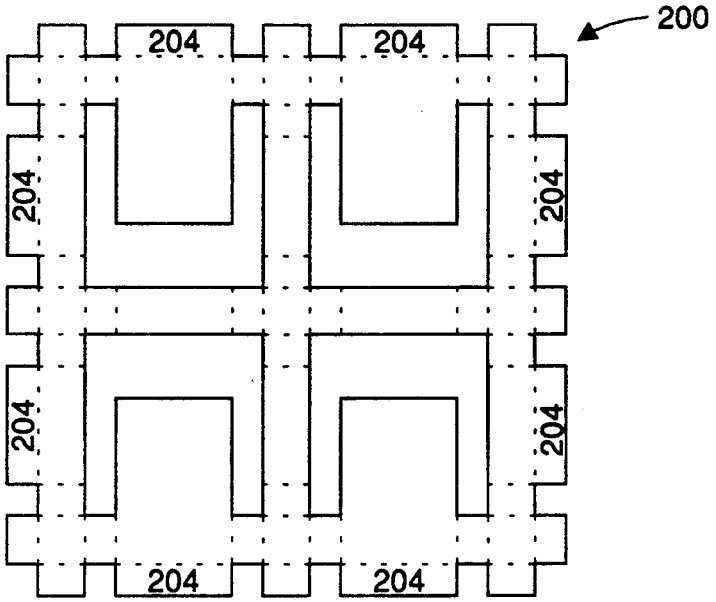
FIGS. 2A and 2B are plan drawings respectively of the lower cover and the upper facing sheet of another variation of the inventive pallet.
Figure 2B:
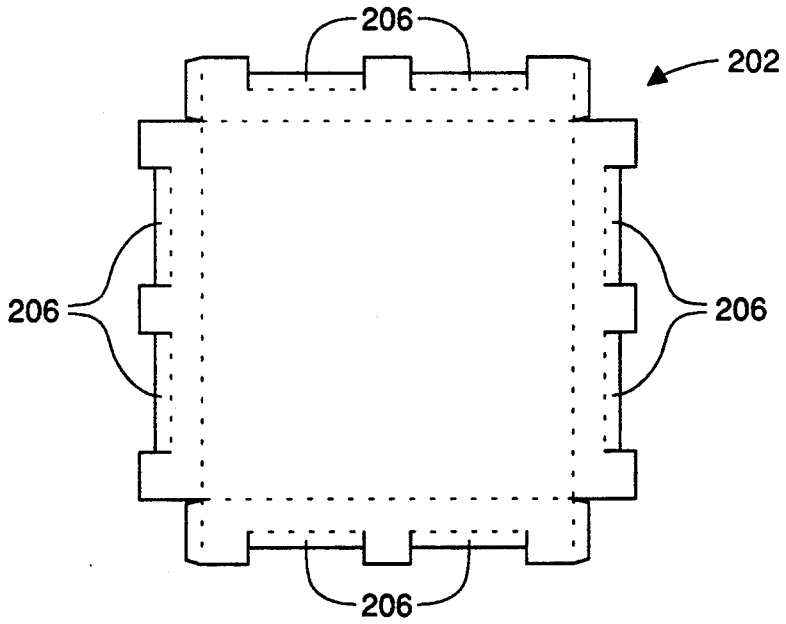

This invention is not limited to the basic variation shown in FIG. 1A. FIG. 2A shows a variation in which the lower cover (200) (the analog of lower cover (110) in FIG. 1A) has tabs (204) which fold over the edge of the center core or deck. The corresponding upper facing sheet (202), as shown in FIG. 2B, has tabs (206) which fold over tabs (204). This results in a visible seam on the edge of the central core. The variation shown in FIG. 1A has a visible seam on the underside of the central core. It is within the scope of this invention to have the various tabs enclosing the central core configured so that the visible seam is on the top of the central platform. Each variation has its benefits and detriments. For instance, the seam on the top of the pallet will form a small ridge which can be used to help maintain certain types of cargo, e.g., loosely bagged bulk materials, etc., in place on the upper side of the central deck.

Figure 3A:
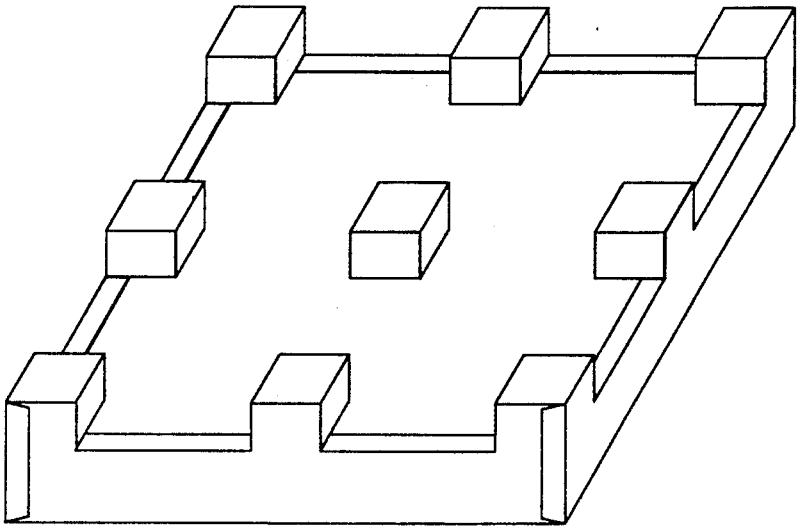
FIGS. 3A and 3B are bottom and top perspective views of a pallet according to the invention.
Figure 3B:
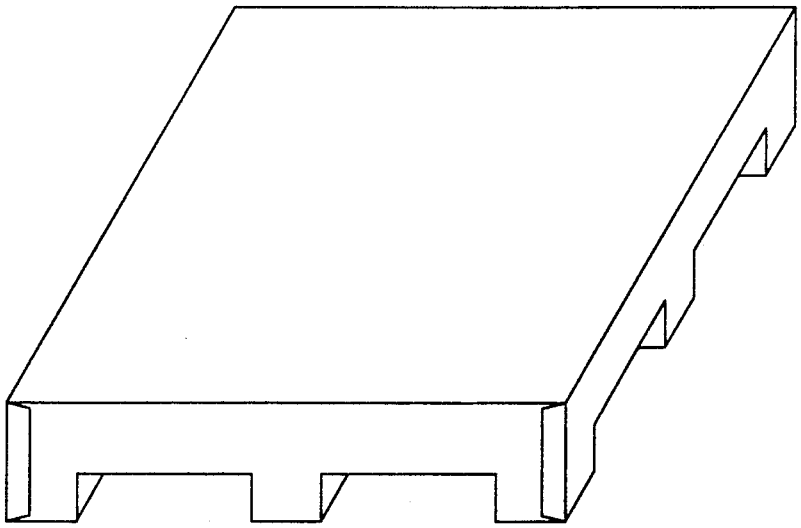

FIGS. 3A and 3B show perspective lower and upper views of the inventive pallet shown in exploded view in FIG. 1A.

The pallet may be coated with a material which will harden or waterproof or dustproof the pallet. These materials may be chosen to meet whatever criteria are appropriate for the pallet use. For instance, if used in a humid atmosphere or used outside or are moved between refrigerated and non-refrigerated areas, waterproofing is desirable. Known water-based and oil-based materials may be applied as needed.

Additionally, the cargo face of the deck may be covered with or coated with a suitable material to prevent slippage of the cargo.

When the pallet of this invention is used in conjunction with roller conveyer systems, a hard paperboard may be glued to the bottom of the covered footblocks. The paperboard is typically one-fourth to one-half inch in thickness and made form thin sheets of paper glued and compressed together to give a hard surface to the bottom of the runners. The hard surface prevents the bottom of the corrugate trays from depressing around the conveyer roller and thereby preventing the load-bearing pallet form rolling easily down the conveyer. The hard paperboard provides adequate hardness for reducing the compressibility of the runner bottom and therefore reduces the drag on the pallet.

The invention has been described by description and by example. The examples are just examples and are not to be used to limit the scope of the invention in any way. Additionally, one having ordinary skill in this art will recognize variations and equivalents within the invention as described which will not necessarily be within the scope of the appended claims.

I claim as my invention:

1. A pallet comprising:

a honeycomb platform having an upper surface, lower surface, and edges;

an upper facing sheet adherent to the upper surface of the honeycomb platform, footblocks adherent to the lower surface of the honeycomb platform, a lower cover patterned so that it comprises portions that cover the footblocks and portions that cover the lower surface of the honeycomb platform, said cover is functionally continuous between adjacent footblocks, and is adherent respectively to the lower surface of the honeycomb platform and the surfaces of the footblocks it covers, said portions that cover the footblocks extending downwardly from said portions that cover the lower surface of the honeycomb platform and a lower facing sheet patterned with openings so that said portions that cover the footblocks protrude through the openings in the lower facing sheet and which lower facing sheet adheres to the portion of the lower cover sheet which adheres to the lower surface of the honeycomb platform.

2. The pallet of claim 1 where the composition of one or more of the honeycomb platform, upper and lower facing sheets, and lower cover sheet is selected from paper, MYLAR, polyethylene, polypropylene (clear or fibrous paper product).

3. The pallet of claim 2 where the composition of one or more of the honeycomb platform, upper and lower facing sheets, and lower cover sheet is selected from paper.

4. The pallet of claim 1 where at least one of the upper facing sheet or lower cover sheet is folded over and adherent to the edge of the honeycomb platform.

5. The pallet of claim 1 where the honeycomb platform is adhesively connected to the upper facing sheet and the lower cover sheet so a substantial portion of cells within the honeycomb platform are sealed.

6. The pallet of claim 1 said footblocks including corner blocks located at corners of the honeycomb platform.

7. The pallet of claim 6 said footblocks including side footblocks located at the approximate centers of the sides of the honeycomb platform.

8. The pallet of claim 7 said footblocks including a center footblock located at the approximate center of the honeycomb platform.

9. The pallet of claim 8 where the footblocks comprise expanded honeycomb.

10. The pallet of claim 1 where the upper facing sheet and the lower facing sheet are corrugate.

11. The pallet of claim 1 where the corrugates have flutes and the upper facing sheet and the lower facing sheet are positioned so that the upper and lower flutes are not parallel to each other.

12. A paper pallet comprising:

an expanded paper honeycomb platform having an upper surface, lower surface, and four edges with corners;

a corrugate upper facing sheet adherent to the upper surface of the honeycomb platform which corrugate has flutes;

corner footblocks adherent to the lower surface of the honeycomb platform and positioned at the honeycomb platform corners;

a lower cover sheet patterned so that it comprises portions that cover the footblocks and portions that cover the lower surface of the honeycomb platform, said cover is functionally continuous between adjacent footblocks, and is adherent respectively to the lower surface of the honeycomb platform and the surfaces of the footblocks it covers, said portions that cover the footblocks extending downwardly from said portions that cover the lower surface of the honeycomb platform and a corrugate lower facing sheet having flutes and patterned so that said portions that cover the footblocks protrude through the openings in the lower facing sheet and which the lower facing sheet adheres to the portion of the lower cover sheet which adheres to the lower surface of the honeycomb platform and positioned so that the upper and lower facing corrugate flutes are not parallel to teach other.

13. The pallet of claim 12 additionally having side footblocks located at the approximate centers of the sides of the honeycomb platform.

14. The pallet of claim 13 additionally having a center footblock located at the approximate center of the honeycomb platform.

15. The pallet of claim 12 where the honeycomb platform is adhesively connected to the upper facing sheet and the lower cover sheet so a substantial portion of cells within the honeycomb platform are sealed.

* * * * *